US005900175A

United States Patent [19]

Kicherer et al.

[11] Patent Number: 5,900,175

[45] Date of Patent: May 4, 1999

[54] RADIANT COOKING UNIT

[75] Inventors: Robert Kicherer; Franz Bogdanski, both of Oberderdingen, Germany

[73] Assignee: E.G.O. Elektro-Gerätebau GmbH, Germany

[21] Appl. No.: 08/685,304

[22] Filed: Jul. 23, 1996

[30] Foreign Application Priority Data

Jul. 29, 1995 [DE] Germany ..... 195 27 826

[51] Int. Cl.[6] ..... H05B 3/68

[52] U.S. Cl. ..... 219/463; 219/458

[58] Field of Search ..... 219/457, 458, 219/463, 464, 465, 466, 467, 468, 451, 452, 453, 490, 492

[56] References Cited

U.S. PATENT DOCUMENTS

| | | | |
|---|---|---|---|
| 3,838,505 | 10/1974 | Doner . | |
| 4,044,348 | 8/1977 | Huebscher | 219/453 |
| 4,150,280 | 4/1979 | Hurko | 219/463 |
| 4,179,179 | 12/1979 | Lowden | 439/610 |
| 4,313,050 | 1/1982 | Abenaim . | |
| 4,380,116 | 4/1983 | Gossler et al. . | |
| 4,486,648 | 12/1984 | Grasso | 219/453 |
| 4,538,051 | 8/1985 | Schreder et al. | 219/466 |
| 4,929,195 | 5/1990 | Seidoh | 439/610 |
| 5,223,697 | 6/1993 | Wilde et al. . | |
| 5,393,958 | 2/1995 | Gross et al. | 219/464 |
| 5,532,458 | 7/1996 | Kratel et al. | 219/464 |

FOREIGN PATENT DOCUMENTS

| | | |
|---|---|---|
| 540 876 | 5/1993 | European Pat. Off. . |
| 612200 | 8/1994 | European Pat. Off. . |
| 2760339 | 1/1979 | Germany . |
| 2943477 | 5/1981 | Germany . |
| 31 41 996 | 5/1983 | Germany . |
| 3606117 | 8/1987 | Germany . |
| 3613902 | 10/1987 | Germany . |
| 4004129 | 8/1991 | Germany . |
| 4331724 | 3/1994 | Germany . |
| 4320214 | 12/1994 | Germany . |
| 4331702 | 3/1995 | Germany . |
| 1569747 | 6/1980 | United Kingdom . |

*Primary Examiner*—John A. Jeffery
*Assistant Examiner*—Sam Paik
*Attorney, Agent, or Firm*—Quarles & Brady

[57] ABSTRACT

A radiant cooking unit comprises a heat insulating material forming a heating element carrier to which electrical heating elements are secured. It is surrounded by a ring-shaped bordering element of a heat insulating material relatively rigid in design. Both moldings are molded together by a ram. In another aspect the outer ring is divided into several ring sectors. A hoop of flat material clasps this ring-shaped bordering element on all sides, the latter being configured as a single-turn induction coil for a pot sensing system and simultaneously clamping the unit together.

21 Claims, 7 Drawing Sheets

RADIANT COOKING UNIT

TECHNICAL FIELD AND BACKGROUND OF THE INVENTION

The invention relates to a radiant cooking unit comprising at least one electrical heating element arranged on a heating element carrier and including a ring-shaped bordering element surrounding the latter at least partly.

Usual cooktop units of this kind consist of a sheet-metal bowl on the underside of which a glass ceramic plate is arranged or carrying the latter itself and in which the individual radiant cooking positions are arranged, these themselves featuring a sheet-metal carrier dish in which the heating elements are applied to the heat insulation material. Each individual radiant heater is pressed against the underside of the glass ceramic plate by spring retaining parts engegaing the carrier dish (cf. DE 27 60 339 C2 and DE 36 13 902 A1).

Also known already are radiant heaters which comprise several heating zones within a cooking position which can be selectively switched ON/OFF to alter the shape and size of the cooking position (cf. DE 29 43 477 C2). From DE 27 60 339 C2 it is further known to dispose rings on the insulation located in a carrying plate which define several heating fields of a multi-unit cooker provided with heating conductors. The concept of such cooktop units hitherto has always been based on the radiant heaters forming the cooking positions being individual units manufactured and functioning as such which are provided with the corresponding proportion of control, monitoring or regulating units or the sensors and terminals thereof as allocated. These units are manufactured, tested and stored independently of each other. In a second production stage these units are then arranged in a sheet-metal bowl and, in conclusion, provided, independently thereof, with control, input or setting units together with the associated power terminals. This applied, and still applies, in conjunction with the present description both for independent cooktops (drop-in cookers) insertable in the opening of a worktop of an item of kitchen furniture and for the range cooktops of a separate cooking range or cookers mountable individually having several cooking positions, all of which are termed cooktop units in the present context.

SUMMARY OF THE INVENTION

The object of the invention is to provide a radiant cooking unit which permits simplified manufacture and installation, particularly permitting savings in components.

This object is achieved by claim 1 and by the method claim.

One such positive contact definition may result from configuring the bordering element of several parts clasping a flange of the heating element carrier. When the bordering element is clasped by a ring, this may form an induction coil for a pot sensing system. It is, however, also suitable to form an outer clamp holding the bordering element together, whereby this clamp is to be grouped together into a ring particularly when the bordering element is composed of several ring sectors or sections thereof. In this arrangement an outer e.g. flange-like projection of the heating element carrier is included positively connected in the recess of the bordering element, so that following tensioning of the ring a cooking unit results which is a closed item in itself without it needing a separate carrier dish.

Particularly advantageous is an embodiment in which the inserted heating element carrier tablet is formed in its edge portion by a punch so that it penetrates into the inside face of the bordering element and joins the heat insulating moldings, which may consist of differing materials, into a single unit.

In this arrangement the bordering element may be made fiberless, for example, of vermiculite and, where required, may also be configured by air chambers or by chambers filled with an even better heat insulating material as a sandwich structure. The ring which is mechanically closed but which may be electrically open, may also form the mechanical fixture for other components, for instance, a temperature limiter which may be defined thereon by means of snap-lock connectors. It is also possible to provide this element with a clip engaging this element at the edge which holds the bordering element and the heating element carrier together and which, if required, forms a spring element.

These and further features are evident not only from the claims but also from the description and the drawings, each of the individual features being achieved by themselves or severally in the form of subcombinations in one embodiment of the invention and in other fields and may represent advantageous aspects as well as being patentable in their own right, for which protection is sought in the present. It will be appreciated that dividing the application into separate sections as well as under intermediate headings does not restrict the reading in its validity in general.

BRIEF DESCRIPTION OF THE DRAWINGS

Example embodiments of the invention are explained in more detail in the following and illustrated in the drawings in which.

CONFIGURATION OF THE COOKTOP

Figure 1:
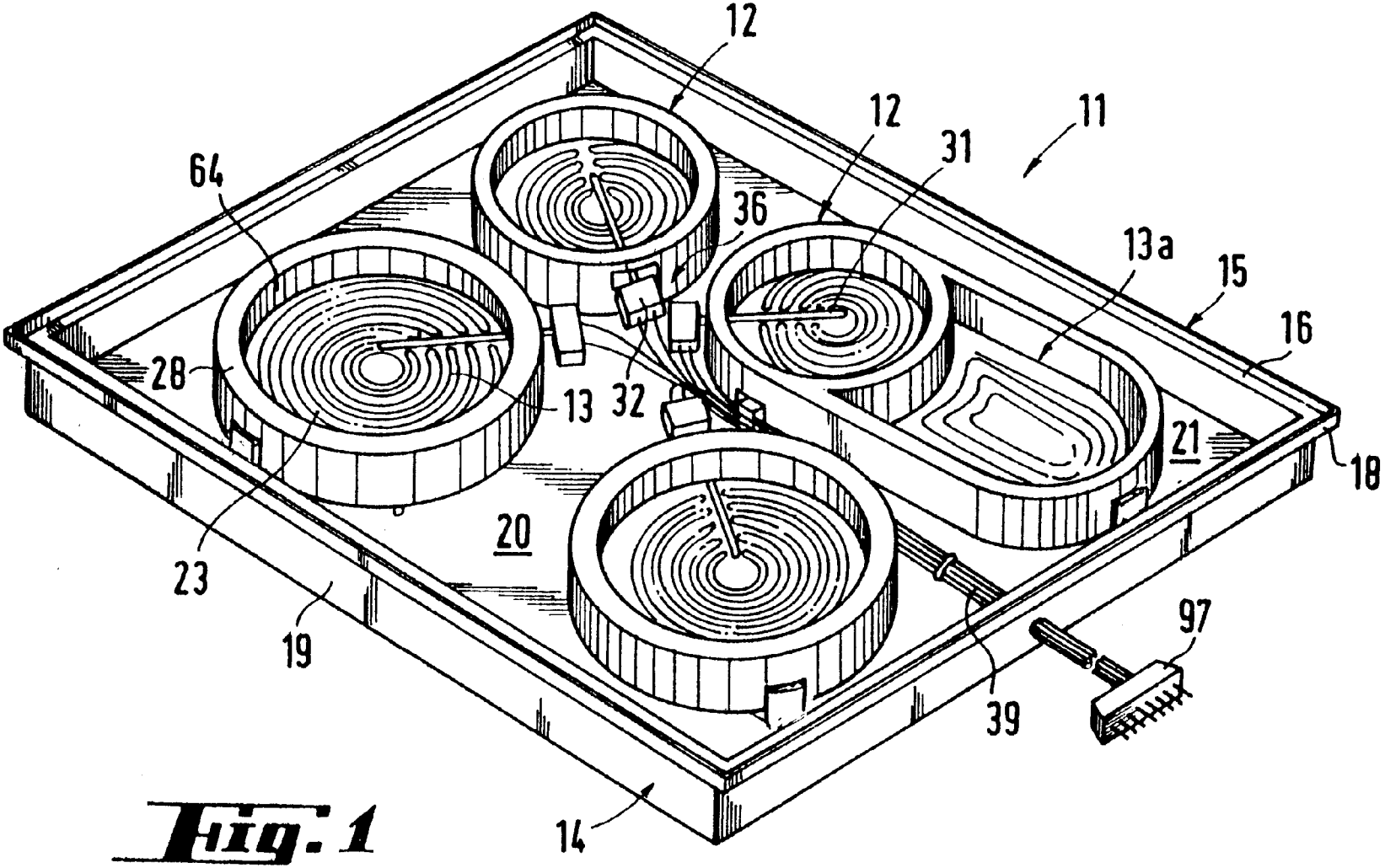
FIG. 1 is a perspective view of a cooking unit (without a glass ceramic plate)
Figure 2:
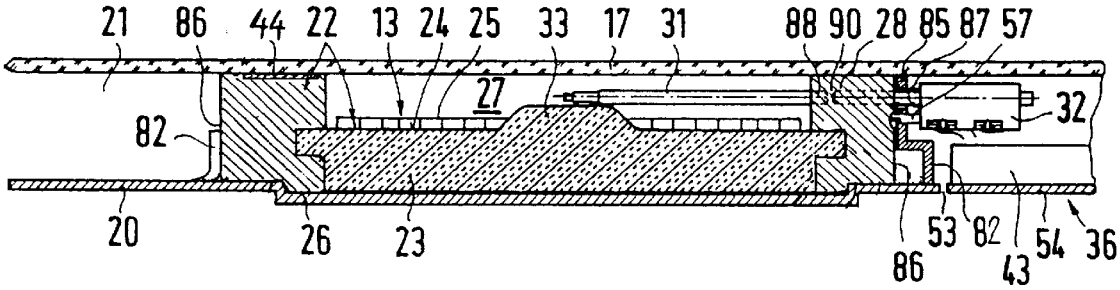
FIG. 2 is a vertical partial section through the unit.

FIGS. 1 and 2 show a cooktop (drop-in cooker) unit 11 comprising four cooking positions 12. of which three individual cooking positions differ in size and each include only one heating zone 13, whilst the fourth features two heating zones, of which the one, like the other cooking positions is circular and also individually ON switchable, whilst the adjoining heating zone 13*a* is additionally ON switchable to form an elongated cooking position, e.g. for heating an oval frying pan.

The cooking positions 12 are arranged in a bowl 14 comprising a rim 15 including a horizontal mounting shoulder 16 on all sides to receive a plate 17, preferably a glass ceramic plate. An upswept outer rim 18 centers the plate and surrounds the outer edge. The cooktop is mostly rectangular in shape including a corresponding four-cornered arrangement of the cooking positions.

The bowl 14 is made of a rectangular, relatively shallow dish of sheet-metal having side-walls 19 and a bottom 20. In the interior space 21 the cooking units 12 are arranged without any own sheet-metal carrier dish. These are made up of individual heat insulating components 22 directly connected to each other and applied to the cooktop. One of the heat insulating components is a disk-shaped heating element carrier. Between the surface 24 of the heating element carrier 23 and the plate 17 a gap exists which forms the heating space 27 of the heating zone 13.

This heating space is surrounded by the other heat insulating component in the form of a bordering element 28 configured ring-shaped which is partly received and centered by a depression 26 in the sheet-metal bowl. This bordering element is positively connected to the heating element carrier 23 and extends up to the plate 17 on which it resiliently rests. The mating with the heating element carrier 23 is described in detail with reference to FIG. 15. On the ring surface of the bordering element 28 facing the plate 17 an inductive pot senor 44 for a pot sensing system is located, where necessary, in a shallow recess. This sensor is configured as a wide-surface, flat, ring-shaped disk of a conducting material, e.g. an iron-based heat-conducting material as a single-turn coil. Accordingly, it is able to react ideally to a cooking untensil standing or shifted on to the plate.

On the periphery of the bordering ring 28 side holders 82 are provided on the recess 14 which may be configured as upswept tabs of the sheet-metal material of the bowl bottom. These engage the outer periphery 86 of the ring-shaped bordering element 28 locating it with respect to side movements. In one side holder 83, which is configured as a Z-shaped sheet-metal tab, a hole 87 is provided which is in line with a corresponding, horizontal hole 29 in the bordering element.

For installation the cooking unit is inserted between the side holders 82, 86. After this, a rod-shaped temperature sensor 31 of a temperature limiter 32 is inserted through the in-line holes 87 and 29. They thus form a bolt 90 establishing the bordering element and thus also the heating element carrier 23 and the temperature regulator 32 itself with respect to the recess whilst ensuring the restricted vertical movability of the bordering element, for which purpose the hole 29 is configured suitably large in the vertical direction.

Due to this arrangement the bordering element 28 of each individual cooking position is able to mate to the underside of the plate 17 by its upper face and thus to define the heating space 27 thermally and visually precisely.

By this arrangement a cooktop unit is provided which contains several cooking positions in a common recess which are defined the one from the other by their outer edges and are heat insulated downwards without each heater being closed off to the outside by a sheet-metal carrier dish and being held together thereby. Instead, this definition is made by the bottom of the recess itself, whereby apart from the preferred definition by sheet-metal tabs punched out of the bowl bottom also other fastening means such as screws, pins inserted in holes or other anchoring means are possible. It is also possible to provided the complete bowl bottom with depressions or holes in a specific pattern arrangement into which corresponding side holders may be inserted selectively. In this case a greater variety of types of cooking positions differing in size and arrangement could be achieved with a single standard recess.

Figure 3:
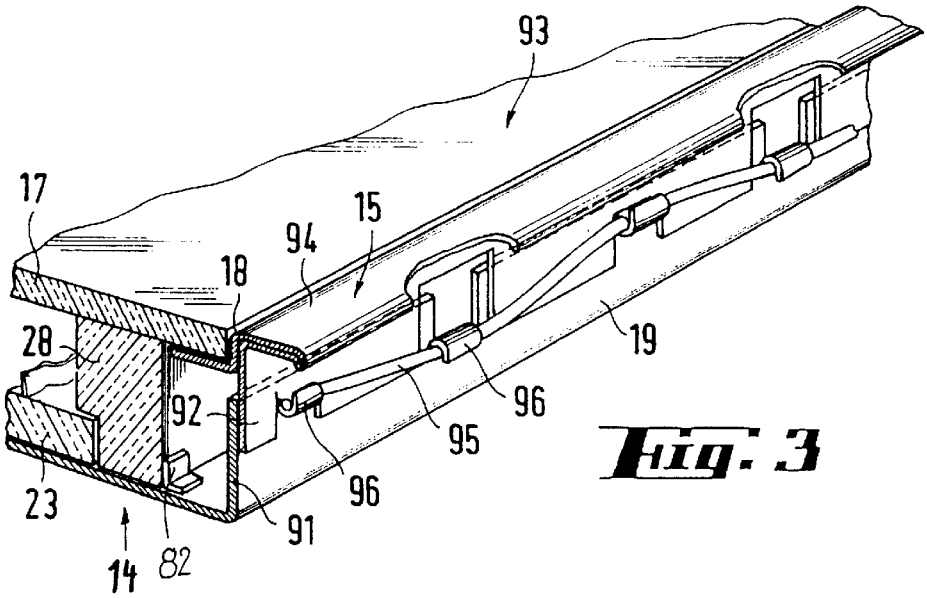
FIG. 3 is a perspective, partly sectioned detail view of a part of the bowl

FIG. 3 shows an embodiment in which the side-walls 19 of the recess are configured two-part, they comprising an upright leg 91 and a downright leg 91 adjoining the outer rim 15, the latter leg being oriented parallel to leg 91 outside thereof on all sides of the recess. This edge component 93 formed of the rim 15 and the leg 92 is fabricated from a sheet-metal section which subsequently forms at the outer edge 18 a horizontal supporting edge 94 slightly downswept on the outside which may rest on a worktop of an item of kitchen furniture, in the opening of which the cooktop unit ll is inserted. This section could also be fabricated as an extruded section.

FIG. 3 shows further that the two legs 91, 92 movable with respect to each other are connected together by a spring wire 95 in such a way that it tends to make the height of the recess smaller, thereby exerting contact pressure on the upper face of the bordering element 28. For this purpose the spring wire 95 is inserted in hook-shaped holder tabs oriented outwardly, each of which is alternately provided at the two legs 91, 92 so that the wire corrugates on being inserted, it thereby exerting a corresponding spring force, This spring action, which is necessary due to a certain tendency of the heat insulating materials to deform, is thus maintained by the spring action as a whole between the plate and the recess.

Figure 4:
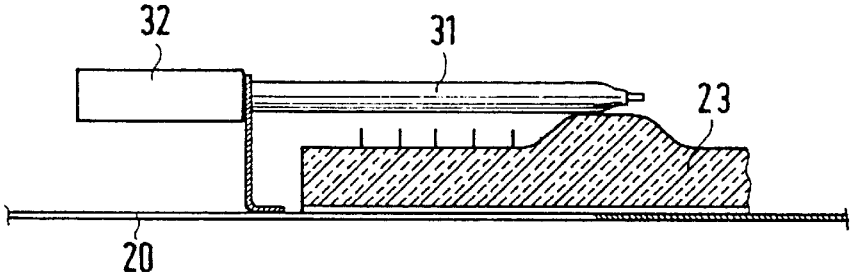
FIG. 4 is a detail of how a temperature limiter is secured.
Figure 5:
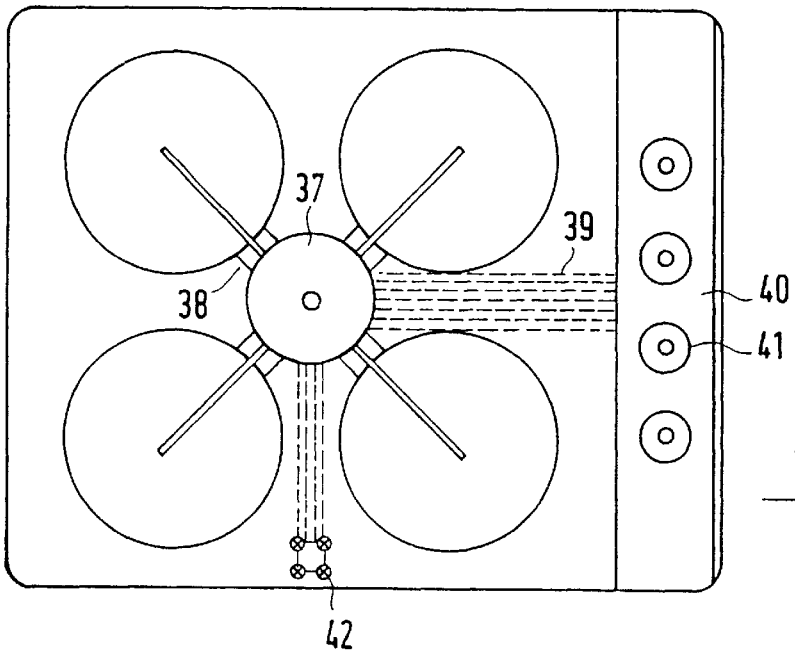
FIG. 5 is a schematic plan view of a cooktop unit

FIG. 4 shows the fastening arrangement of the temperature limiter 32 directly on the bowl bottom 20 by means of an angled sheet-metal connecting part provided on the temperature limiter, whereby this part may be defined on the bottom of the recess e.g. by spot welding.

Figure 13:
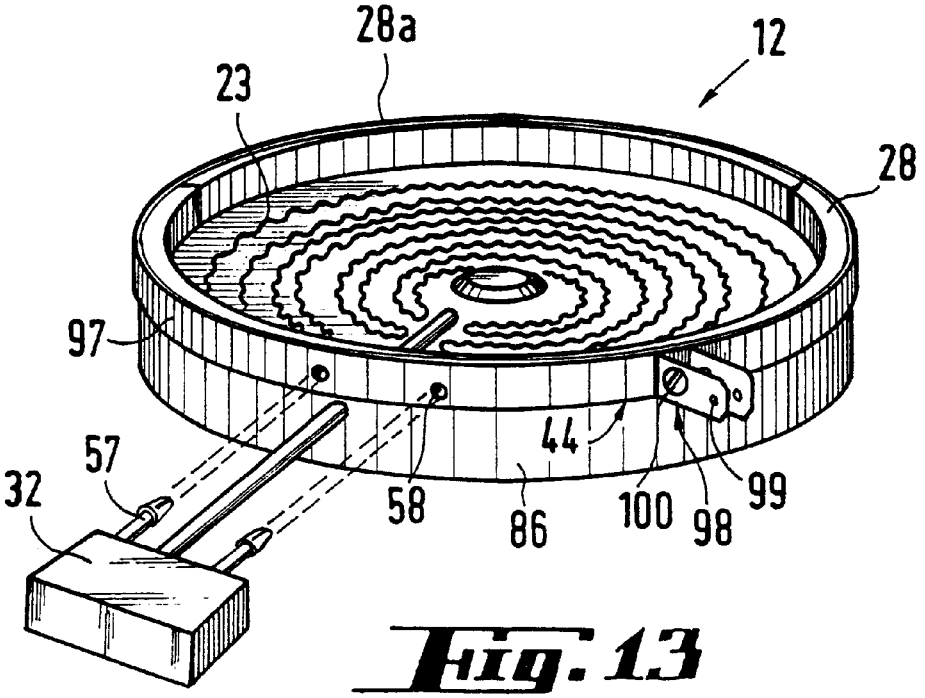
FIG. 13 is a perspective view of a cooking unit, FIG. 14 a partial section through FIG. 13

FIG. 13 shows a cooking position 12 comprising a heating element carrier 23 and a bordering element 28 made up of several parts. The latter is as a whole ring-shaped, but composed of individual ring segments 28*a* which are mated to each other. Surrounding the outer periphery 86 is a clamp-type ring 97 forming the pot sensor 44, this ring being open at one point where it features two outwardly oriented bends 98, the ends of which form blade receptacles 99. The ring is tensioned together by means of an electrically insulating connector means, for example a ceramic clamp or a screw 100 and thus clamps the cooking unit together.

On the blade receptacles 99 corresponding blade terminals are fitted which connect the sensor 44 to the corresponding control unit for an inductive pot sensing system.

In the ring 97 openings 58 may also be provided into which snap-lock or insertion connectors 57 may be inserted to establish the temperature limiter 32 (see also FIG. 2).

Figure 14:
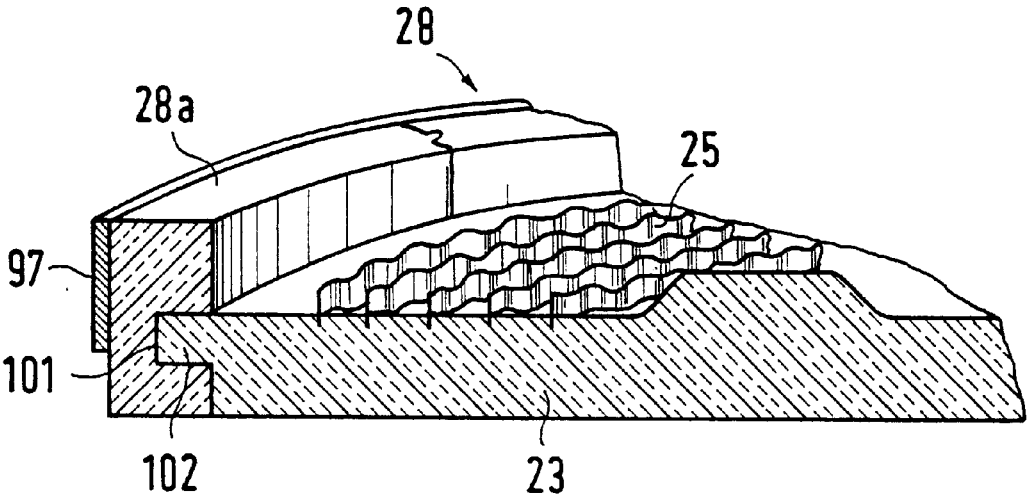

FIG. 14 shows a partial cross-section through the embodiment shown in FIG. 13 in which it is evident that the ring segments 28*a* of the bordering element 28 cross-sectionally feature a recess 101 open inwardly in which a corresponding ring projection or flange 102 engages at the outer periphery of the heating element carrier 23. Since the ring segments 28 are held together by the hoop or clamp 97, by adding the pot sensing coil an integral cooking position is provided. The hoop 97 locates around the outer periphery and extends up to the upper edge of the bordering element, i.e. up to the underside of the plate 17.

FIG. 15 shows an aspect, again with a hoop 97 which however is not needed for holding-together, in which the bordering element 28 is configured integrally as a ring. In cross section it has the shape of a modified L, the leg of the L protruding inwardly being located at the bottom so as to form a lower outer edge of the cooking position component provided with a recess 102 on all sides. In the region of this recess 102 blind holes 103 are also provided for in the bordering element 28 which are able to engage in corresponding projections on the recess during fitting. In addition to this they are suitable to serve as alignment aids during an automated fitting procedure.

The heating element carrier 23 is adapted to the internal shape of the bordering element 28 and has accordingly an upper, peripherally protruding flange configured with a slightly lesser diameter at the bottom. In the region of the outer flange 105 the heating element carrier 23 is fastened to the inside of the bordering element 28 by material of the heating element carrier 28, after being located at several positions peripherally, it being forced into moldings 106 on the inside of the bordering element 28 by the downward action of a punch. As a result of this the heating element carrier 23 is postively locked to the bordering element 28 by the shaping of the heat insulating material, the punch thereby forming depressions or impressions 107 in the surface 24. This shaping action is done preferably at several locations peripherally, but may also be done on all sides. The result is that both heat insulating moldings hold together well by the shaped material permitting somewhat stronger compaction at the shaping points.

Figure 16:
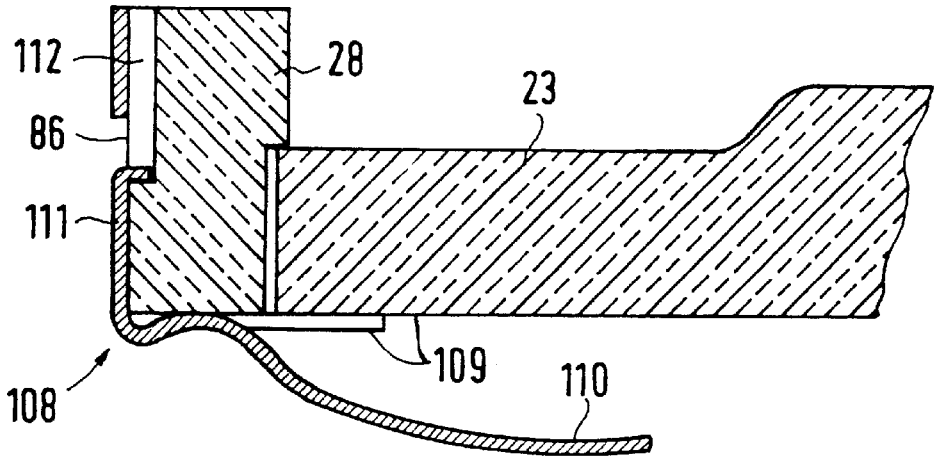

The resulting mating may also be undertaken simply or additionally vertically instead of, as shown in FIG. 16, horizontally, whereby the recesses could be configured relieved, i.e. flared. Depending on the nature of the material concerned the bordering element 28 may also be shaped.

Figure 15:
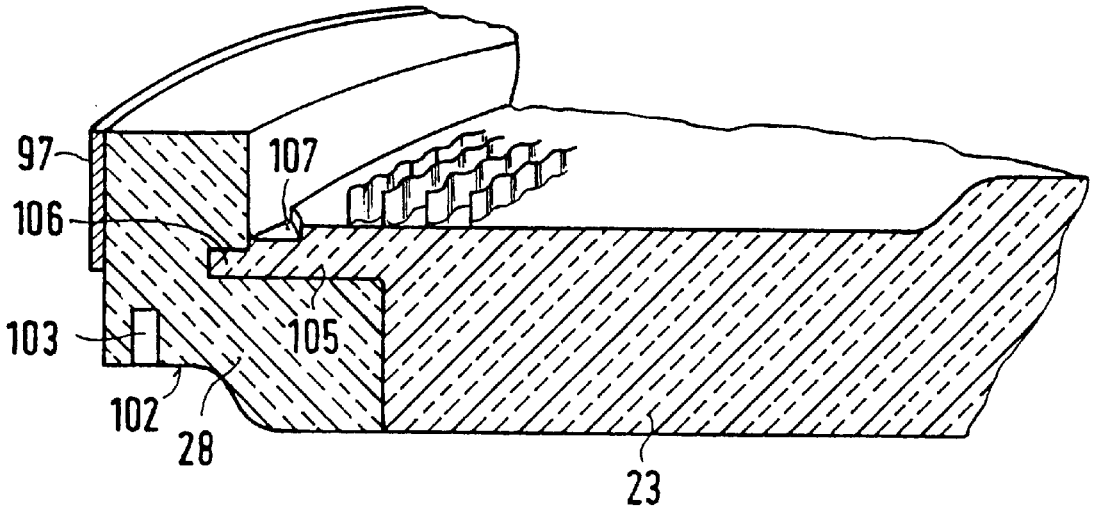
FIGS. 15 to 16 shows variants in partial section.

By means of the aspects shown in FIGS. 13 to 15 a radiant heater cooking position is provided in which the sheet-metal bowl usually required is eliminated. It is, in addition to this, possible to do without reinforcement fibers, due to the protection provided to regions exposed most to wear and tear, so that the complete radiant heater can be manufactured fiberless. The rim, as to be further explained in the following, may consist of a relatively dimensionally rigid material, but with chambers filled with air or with a material having better heat insulating properties than the remaining material of the bordering element 28. Thus, it would also be possible, for example, to make the molding 106 filled with the material of the heating element carrier 23 larger and to extend it over a considerable section of the height of the rim forming the bordering element 28, resulting in an aspect similar to that shown in FIG. 11. The ring or hoop 97 forming the pot sensing coil is mechanically closed but electrically "open". The connection may be be made galvanically, as described, or also via an air transformer or other kind of transfer element, for instance, by ferrite.

FIG. 16 shows an aspect in which the outer face 86 of the bordering element 28 is configured such that individual clips 108 may be accommodated therein, established by the bordering element 28 and extend partially above the bottom 109 from the bordering element 28 and the heating element carrier 23 to thus be held together. Furthermore, a spring section 110 may be provided thereon which is supported by the bottom 20 of the recess. Such an aspect is particularly of advantage in case of repair when a cooking position needs later to be replaced new. The clip 108 is held by a nose 111 which engages a groove 112 on the outer periphery 86 of the bordering element 28. The clip may be fabricated of a resilient sheet metal.

HEAT INSULATION

In selecting the heat insulating material and its design not only the temperature compatibility and possibly also the electrical insulation need to be taken into account but also the properties which mainly tend to exclude each other normally, namely good heat insulating properties and mechanical strength, this being the requirement in selecting the material of the heat insulating components 23.

For the heating element carrier 23 a pyrogenic silicic aerogel compacted mixed with suitable binding and clouding agents, for example of metal oxides, into a tablet-like molding, i.e. a more or less thick disk adapted to the shape of the heating zone. To boost the mechanical strength reinforcing agents may be added, whereby fibers should be avoided where possible, however.

In the upper face 24 facing the heating space 27 electrical resistive heating elements 25 are embedded. These consist of thin corrugated strips which are pressed upright into the heat insulating material by feet provided on their underside, formed spade-like by the corrugation after the tablet has been compacted. Due to their large surface area as compared to the mass of the heating element these heating elements feature a very fast glow response, they being known by the tradename "HiLight" of the Applicant. As regards further details as to the nature, fabrication and function thereof, express reference is made to DE-42 29 373 and DE-42 29 375.

The heating element carrier 23 features in the middle of its otherwise flat surface 24 an upright projection 33 of which the temperature sensor 31 of the temperature limiter 32 rests. This sensor extends, depending on the size of the heating zone, up to the middle or even slightly past thereof, so that a uniform temperature sensor length is selectable even in the case of differing heating zone diameters. It is normally possible due to the HiLight system to produce a heating element carrier of sufficient heat insulating quality and mechanical strength, particularly when it is required to be thicker. One particular advantage of the integrated cooktop concept is that the space necessary to arrange the carrier dish receibing the radiant heater in the recess and to press it upwards is now available for the heat insulating so that for the same overall height of the recess the heat insulation may now be a few millimeters thicker. If, however, special requirements, for instance an even shallower recess depth or the like make it necessary, a further heat insulating layer may also be located under the heating element carrier, this then usually being of an even lighter material of the same type, for thus better heat insulation. Also possible is a sandwich configuration of the heating element carrier tablet.

The bordering element 28 consists of a mechanically more solid material, i.e. which is both more rigid in design and more resistant to attrition. Such materials may for instance be slurries of heat insulating materials of felt or paper consistency molded with ceramic fibers. The general tendency is, however, to avoid fibers in heat insulating materials. Accordingly, preference is given to a material which is very rigid in design, such as vermiculite, preferably an expanded mica which whilst exhibiting very good mechanical properties is a good electrical insulator featuring reasonable heat-insulating and temperature resistance properties. It is from this material that the bordering element 28 is molded, which is possible in particular with high rim accuracy so that it is especially suitable particularly for the precise visual definition of the heating zone. Fundamentally, this material has a mechanical consistency like that of a plastics or integrally foamed material having a dense surface.

Figure 11:
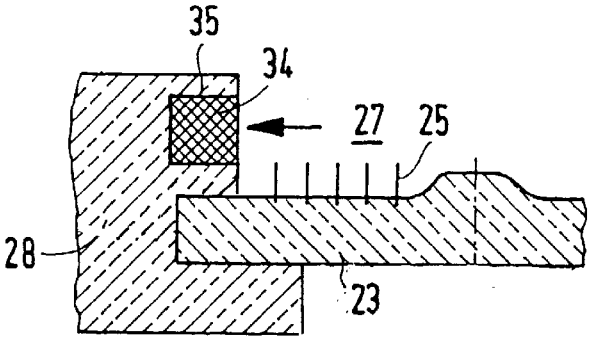
FIG. 11 is a partial section showing a sandwich version of the bordering element.

At positions necessitating a particularly high resistance to temperature and/or heat insulation, inserts 34 may be included in the bordering element 28, FIG. 11 showing such an insert 34 on the side of the bordering element facing the heating space 27, it preventing heat dissipation to the side. The insert is molded in the form of a ring inserted on all sides in a groove 35 in the bordering element 28. The top and bottom flanges left standing are not so endangered thermally since they adjoin, on the one hand, the plate 17 and, on the other, the heating element carrier 23. As a result of these inserts being of a material different to that of the remaining heat insulating component a composite structure is provided which endows the component the characterics of both properties, which as such contradict each other, namely mechanical strength/good heat insulation properties. This compact structure may also otherwise be put to use, for example, in the items surrounding the controller unit described below, or in other recesses provided in the top or on the outside of the bordering element.

CONTROL AND REGULATION

The arrangement of the cooking positions in a common bowl illustrated in FIG. 1 enables the control. regulating, monitoring and connecting elements to be grouped together for all cooking positions, whereas hitherto, at least as regards the components themselves related to the cooking positions, for example the temperature limiter and connecting leads, hot alerts or pot sensing systems they were assigned to each individual cooking position.

As illustrated in FIG. 1, the temperature limiters 32 are located in a central portion 36 between the four cooking positions. It is also posssible to accommodate the four temperature limiters, where needed, together with the hot alert contacts, signalled by the same temperature sensor, in a common housing 37 from which the temperature sensors emanate star-shaped. From here, the cooking position terminals 38 also run directly to the heating elements. From the common housing a cable harness identified in FIGS. 1 and 4 by the reference numeral 39 runs to the input and display panel 40 respectively which in this case features setting knobs 41 passing through the glass ceramic plate. Instead of a cable harness of leads or solid wires a multi-track matrix of ribbon conductors may also be employed. Indicator lamps 42 for a hot alert are provided in a corresponding arrangement to the cooking positions at a suitable location. Temperature or power control and regulating members, influenced by the setting knobs 41, may be provided in the region of the setting panel 40 or also within the common housing 37.

The residual heat indicator normally termed hot alert makes sure the user is alerted that a cooking position may still possible have a temperature hazardous to touch. For its activation a second contact is normally provided in the temperature limiter which is activated by the sensor of the temperature limiter, the switching action of which occurs at 70° C. for instance. The hot alert could, however, also operate with other, for example, electrical resistive sensors, especially when a common control electronics circuit is provided. However, the same purpose may also be satisfied by a control system which operates as a function of time, depending on ON activation of the cooking positions, by the hot alert responding with a corresponding safety margin once the heater has been ON for a certain time. This control runs on for the average cooling-down time to less than a hazardous temperature following OFF of the heating element, it not being until then that it deactivates the hot alert. In this arrangement, for instance, it may be provided for, that a fleeting e.g. accidental ON fails to immediately activate the hot alert.

Figure 12:
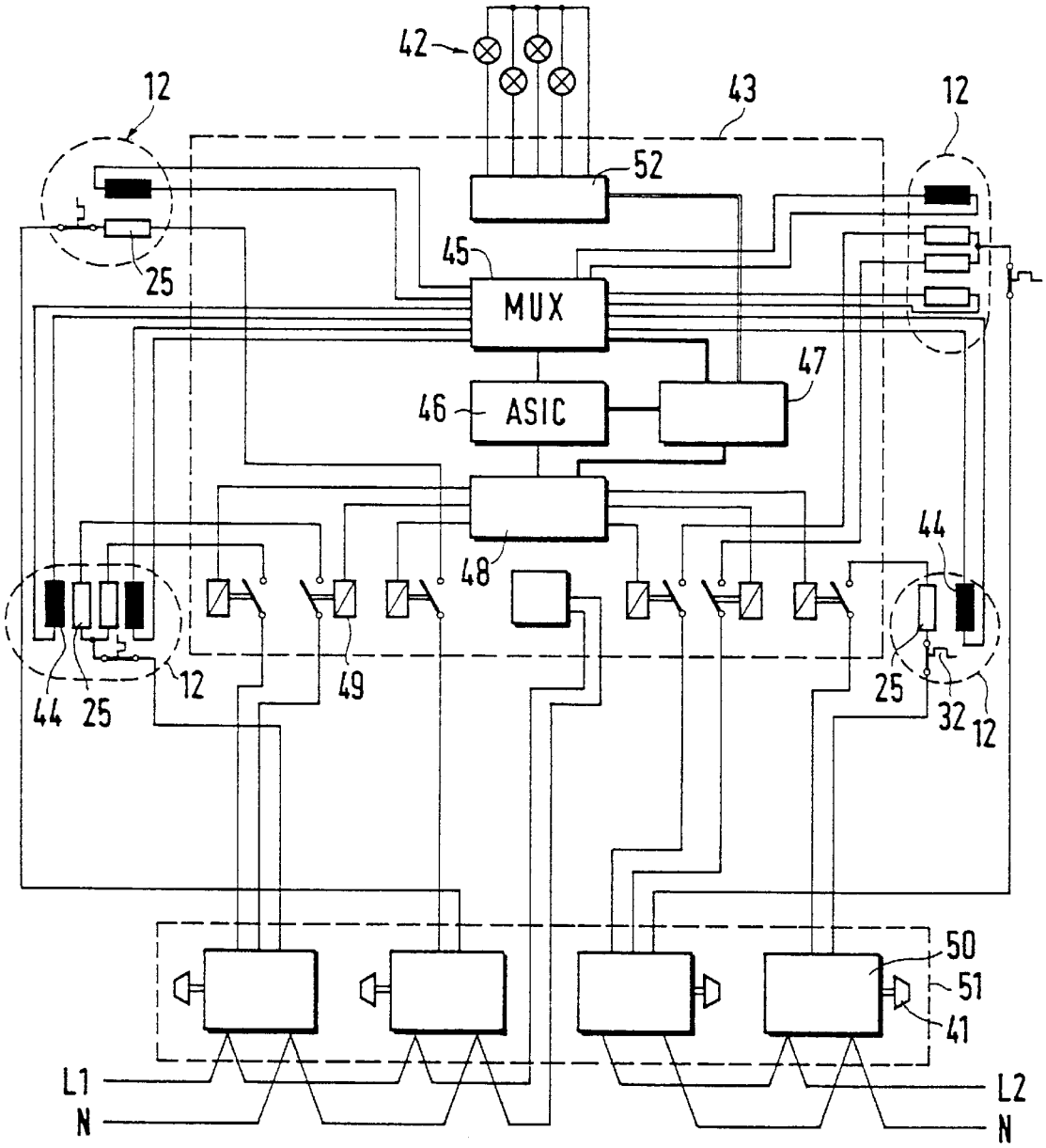
FIG. 12 is a block circuit diagram of a controller.

In FIG. 12 a central regulating and control circuit is illustrated in the block diagram. The controller 43 is provided for four cooking positions 12, of which two (at the top left and bottom right) each have a heating element 25 whilst the other two (bottom left and top right) each have two heating elements, e.g. for a cooking position incorporating two heating zones 13, 13*a*.

The controller also contains a pot sensing electronic circuit. For this purpose induction coils 44 are provided at the cooking positions, i.e. one for each heating element, connected to the controller. These pot sensing systems are connected to a multiplexer 45 permitting serial signal processing. The signals thus arriving in sequence are processed in a specially adapted integrated circuit (ASIC) 46, partly under the control by a microprocessor 47.

Via a driver 48 the resulting output signals are applied to circuit breakers 49 represented by electromechanical relays but which may also be configured as electronic power components. In the example embodiment of FIG. 12 power control is done outside of the controller 43 in power controllers 50 which are operated by the setting knobs 41 and which may be provided singly or grouped together in a common block 51. The power controllers, also termed, energy controllers, mostly operate with pulsed power release and may operate electrothermally or electronically.

It is, however, also possible to integrate this power control feature in the controller 43 and to merely bring out the setting members. In this arrangement selectively any type of input means, for instance, shaft encoders such as potentiometers, or key pads, preferably touch controls may be involved which, as required, are also effective through the glass ceramic plate. In such a case a key pad could be applied in the region of the setting panel 40, by the touching of which the user is able to affect selection of the individual cooking positions and their settings.

The microprocessor also controls the hot alert panel 42 in the form of LEDs via a corresponding signalling arrangement. The temperature limiters are in this case provided circuit-wise outside of the controller 43, but may also be configured integral therewith to a major degree.

The controller is provided in the central portion 36, it being shielded from the heat given off by the heating zones by suitable heat insulation. As shown in FIG. 2 it is able to dissipate heat via the bottom 20, if required also upwards via the glass ceramic plate along as the temperature handling level of the electronic circuitry is relatively high enough. Here too, further means could contribute towards cooling, for example, an interruption in the bottom 20 round about the central portion, for instance, by the slots 52 shown in FIG. 2, by heat sinks mounted in this portion or even by active cooling by means of a Peltier element.

In any case, a common controller also permits making use of functions which are technically relatively complicated, such as pot sensing, because the expense for several cooking positions is hardly greater than for a single one.

Evaluating the signals of the pot sensing systems 44 may be in keeping with state of the art requirements, for example according to DE-40 04 129 to the contents of which reference is expressly made in this context.

Figure 6:
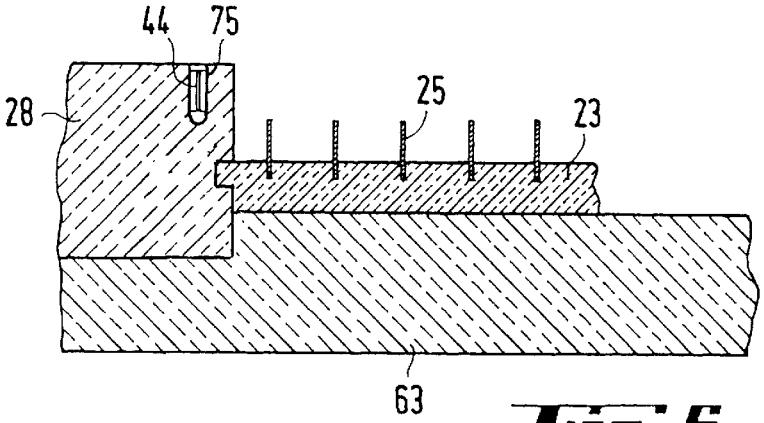
FIG. 6 is a section detail of how a pot sensing coil is fastened.
Figure 7:
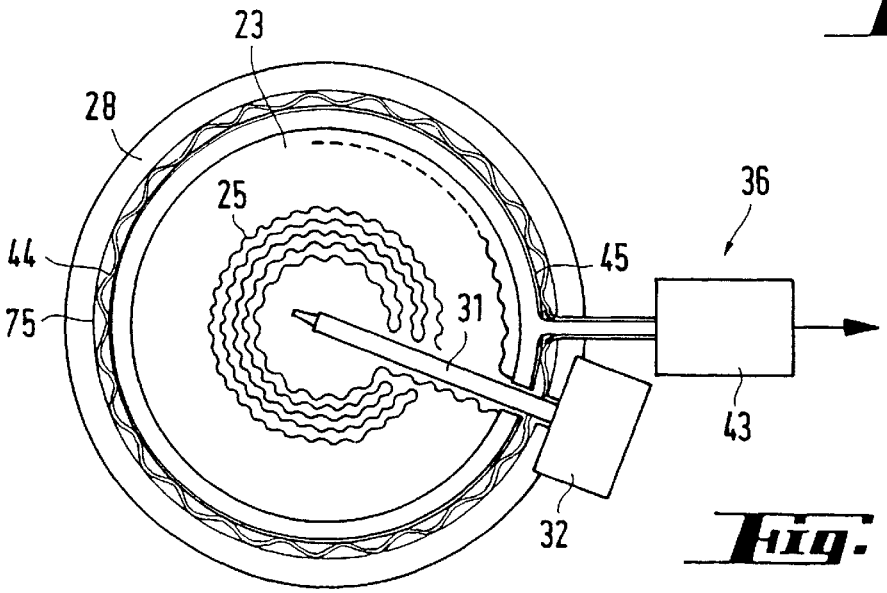
FIG. 7 shows the embodiment of FIG. 6 in a plan view

Due to the ambient conditions involved, particularly the high and changing temperature, however, the arrangement of the pot sensing systems, which are of course configured as induction coils, is particularly critical. In the FIGS. 6 to 9 various variants are shown, each of which is designed as single-turn coils. FIGS. 6 and 7 show an aspect in which the bordering element 28 includes a ring-shaped slot emanating from its top face, in which a single-turn loop as the pot sensing system 44 is inserted. This loop is made of a metallic band material and is, as shown in FIG. 7, lightly corrugated to hold itself securely in the slot. Its terminals are led to the central portion 36 where they are connected to the controller 43 by conductor lengths which are exposed as little as possible. Since it is very important to maintain these terminals as short as possible, here too individual pot sensing components may be arranged in the heat insulation in the vicinity of the individual cooking positions. In this way it is possible to also evaluate with sufficient accuarcy the relative fuzzy and possibly noisy signals of a single-turn induction coil which may be unshielded in its connecting portion.

Figure 8:
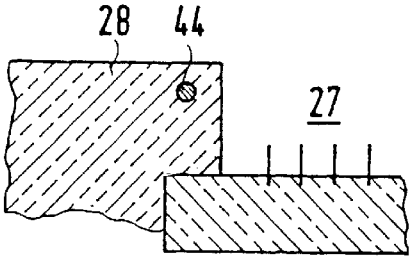
FIGS. 8 and 9 show further embodiments of the fastening arrangement of an induction coil for pot sensing.

FIG. 8 shows an aspect in which an upright band of flat material is used as the pot sensing system 44, the same as in the FIGS. 6 and 7, which—similar to the heating conductors 25—is embedded in the heating element carrier 23 by being pressed into place over part of its height. To counteract excessive heating-up a reflective coating may be provided on the band, for example. It is of advantage for these pot sensing components that the cooking position in each case is configured without a surrounding sheet-metal rim, which could consistute an unwanted shielding.

Figure 9:
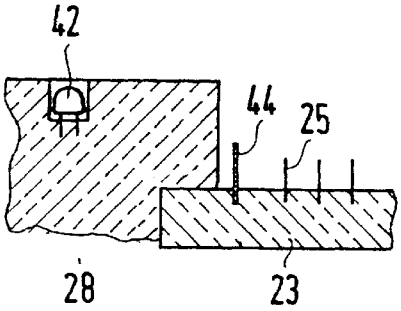
Figure 10:
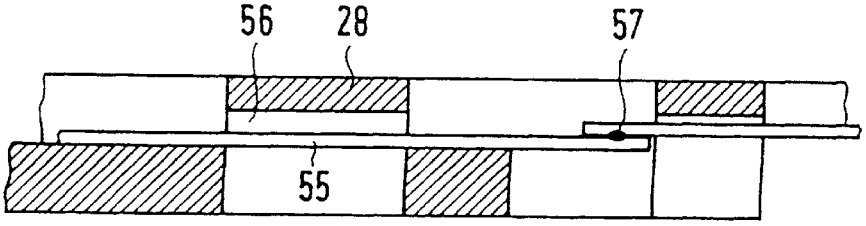
FIG. 10 is a detail of how connecting leads are run.

FIG. 9 shows that an indicator lamp 42 formed as an LED for the hot alert may be inserted directly in a recess of the bordering element 28, it then glowing through the plate.

TERMINALS

The arrangement described permits also the routing of the terminals to be especially favourably configured. For one thing, by grouping together the various regulating and control members, internal wiring can be eliminated to a major extent and, for another, circuiting also the individual cooking positions to the central controller or other members can already be done during manufacture of the cooking positions and thus also simultaneously with production of the bowl. When grouped together into a cable harness 39, in which the cables are provided originally at the individual switching elements, a common connector plug (97 in FIG. 1) may in conclusion be provided for connection to the input or setting instruments.

In particular, however, circuiting by means of a cable harness 39 or a connection matrix is possible which may be prepared with precisely specified connection lengths and items. Thus, for example, connections of solid wire could be run in corresponding passageways of the bordering element 28. Especially preferred is an electrical circuiting arrangement comprising bands or strips 55 which are inserted in corresponding passageways 56 in the bordering element 28. These passageways could, for example, also easily be produced within the bordering element by molding rams offset with respect to each other, in which the ribbon conductors 55 are placed or inserted. It is also possible, however, to guide them through corresponding recesses in the parting plane between bordering element and heating element carrier, they then automatically being connected when these parts are joined together.

The heat conductor bands may be made of nickel-plated steel band, for example, which, as required, may be connected to each other by spot welds 57. They may also be produced already as a corresponding matrix by punching. The low electrical conductivity of iron may be compensated by corresponding dimensioning. In any case, however, this results in conductors which are heat-resistant and easily weldable.

We claim:

1. A radiant cooking unit comprising:

at least one electrical heating element arranged on a heating element carrier;

a ring-shaped bordering element at least partly surrounding the heating element;

said heating element carrier and said bordering element being directly and positively connected to each other;

spring means;

a frame-like plate carrier; and, said unit being arranged underneath a plate within a bowl, said bowl being resiliently mounted and spaced from said plate by said spring means provided between said bowl and said frame-like plate carrier.

2. The unit according to claim 1, further comprising ring clasping said bordering element, said ring being an induction coil for a pot sensing system.

3. The unit according to claim 1, wherein said bordering element and said ring form an outer definition of a cooking position.

4. The unit according to claim 2, wherein electrical terminals of said cooking position, which emanate from associated temperature limiters, are provided pre-assembled thereon and are grouped together on installation into a cable harness provided with a common multiple connector.

5. The unit according to claim 1, wherein said bordering element comprises several ring sectors.

6. The unit according to claim 1, wherein said bordering element includes at least one recess in which a part of said heating element carrier engages.

7. The unit according to claim 1, wherein said recess is filled by molding with material of said heating element carrier and is located in a portion of an impression molded in a surface of said heating element carrier.

8. The unit according to claim 1, wherein several units are arranged underneath said plate within a bowl consisting of sheet material, individually and directly on said bowl.

9. The unit according to claim 8, wherein spacer and side holders and their fasteners are provided on the bottom of said bowl, as prepunched and shapable sheet-metal cutouts.

10. The unit according to claim 9, wherein the spacer and side holder are arranged on the bowl bottom in a pattern adaptable to the various sizes and arrangements of said cooking positions.

11. The unit according to claim 8, wherein in a central portion of said bowl electronic components are arranged.

12. The unit according to claim 1, wherein at least one heat insulating component belonging to a cooking position is directly guided on receiving means belonging to said bowl.

13. The unit according to claim 1, wherein said heating element carrier and said ring-shaped bordering element form separate heat insulating components.

14. The unit according to claim 13, wherein the heating element carrier comprises silicium aerogel and the bordering element comprises a fiberless insulating material.

15. The unit according to claim 13, wherein said heat insulating components are composed of differing heat insulating materials, inserts of a first material, with relatively better heat insulating properties than a second material, being provided in said second material, said second material having mechanically more rigid properties than said first material.

16. The unit according to claim 13, wherein said heating element carrier is molded from a compacted bulk-flowable heat insulating material and said ring-shaped bordering element is molded from a relatively rigid heat insulating material.

17. The unit according to claim 16, wherein said heating element carrier is tablet-shaped and said relatively rigid heat insulating material is vermiculite.

18. The unit according to claim 1, wherein a residual heat indicator system to alert to the hazard of burn injuries from contact with said cooking position is configured time-controlled without a temperature sensor.

19. The unit according to claim 1, wherein said heating element carrier and said bordering element are insulating components having electrical terminals are integrated therein.

20. The unit according to claim 1, wherein said heating element carrier and said bordering element are insulating components having electrical terminals arranged therebetween in partially relieved passages.

21. The unit of claim 1, further comprising electrical terminals configured as flat conductors in a punched matrix.

* * * * *